US011289845B2

(12) United States Patent
Geske et al.

(10) Patent No.: US 11,289,845 B2
(45) Date of Patent: Mar. 29, 2022

(54) MODULAR SYSTEM FOR PRODUCING AN ELECTRICAL UNIT AND TERMINAL DEVICE

(71) Applicant: Phoenix Contact GmbH & Co. KG, Blomberg (DE)

(72) Inventors: Ralf Geske, Schieder-Schwalenberg (DE); Simon Follmann, Extertal (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 0 days.

(21) Appl. No.: 16/764,899

(22) PCT Filed: Jan. 11, 2019

(86) PCT No.: PCT/EP2019/050631
§ 371 (c)(1),
(2) Date: May 18, 2020

(87) PCT Pub. No.: WO2019/141597
PCT Pub. Date: Jul. 25, 2019

(65) Prior Publication Data

US 2020/0343667 A1 Oct. 29, 2020

(30) Foreign Application Priority Data

Jan. 22, 2018 (BE) ..... 2018/5032

(51) Int. Cl.
*H01R 4/48* (2006.01)
*H01R 13/514* (2006.01)
(Continued)

(52) U.S. Cl.
CPC ..... *H01R 13/514* (2013.01); *H01R 4/363* (2013.01); *H01R 4/4836* (2013.01);
(Continued)

(58) Field of Classification Search
CPC .... H01R 13/514; H01R 4/363; H01R 4/4836; H01R 12/716; H01R 12/75; H01R 13/621
(Continued)

(56) References Cited

U.S. PATENT DOCUMENTS 6,004,163 A 12/1999 Beckman et al.
6,146,187 A * 11/2000 Pallai ..... H01R 4/4836 439/431
(Continued)

FOREIGN PATENT DOCUMENTS

DE 19813753 A1 9/1999
DE 10253486 A1 5/2004
(Continued)

*Primary Examiner* — Abdullah A Riyami
*Assistant Examiner* — Nelson R. Burgos-Guntin
(74) *Attorney, Agent, or Firm* — Leydig, Voit & Mayer, Ltd.

(57) ABSTRACT

A modular system for producing an electrical device includes: a plurality of terminal devices arrangeable on a printed circuit board to connect electrical conductors to the printed circuit board, the terminal devices each having a housing that has a connection side, arranged on which is a plug-in connection opening for insertion of an electrical conductor, and two lateral flanks, which are spaced apart
(Continued)

from each other along a width direction and between which the connection side extends. A first terminal device of the plurality of terminal devices is a spring-force terminal. A second terminal device of the plurality of terminal devices is a screw-connection terminal. A housing of the first terminal device and a housing of the second terminal device have a same width, measured along the width direction.

16 Claims, 3 Drawing Sheets

(51) Int. Cl.
*H01R 4/36* (2006.01)
*H01R 12/71* (2011.01)
*H01R 12/75* (2011.01)
*H01R 13/621* (2006.01)

(52) U.S. Cl.
CPC ..... *H01R 12/716* (2013.01); *H01R 12/75* (2013.01); *H01R 13/621* (2013.01)

(58) Field of Classification Search
USPC ..... 439/701
See application file for complete search history.

(56) References Cited

U.S. PATENT DOCUMENTS

| | | | | |
|---|---|---|---|---|
| 7,094,071 | B2 * | 8/2006 | Hackemack | H01R 4/16 439/76.1 |
| 7,384,317 | B1 * | 6/2008 | Pijoan Parellada | H01R 4/363 439/814 |
| 9,263,809 | B2 * | 2/2016 | Assif | H01R 4/5008 |
| 2007/0049104 | A1 * | 3/2007 | Reibke | H01R 4/2433 439/404 |
| 2011/0065330 | A1 | 3/2011 | Brown et al. | |
| 2016/0049737 | A1 | 2/2016 | Classen et al. | |
| 2018/0006385 | A1 * | 1/2018 | Wilinski | H01R 4/4836 |
| 2018/0248276 | A1 * | 8/2018 | Kettern | H01R 4/4836 |
| 2018/0358715 | A1 * | 12/2018 | Geske | H01R 13/62955 |
| 2019/0123462 | A1 * | 4/2019 | Geske | H01R 12/515 |
| 2020/0136276 | A1 * | 4/2020 | Geske | H01R 4/40 |

FOREIGN PATENT DOCUMENTS

| | | | |
|---|---|---|---|
| DE | 102010037518 | A1 | 3/2011 |
| DE | 102012110895 | A1 | 5/2014 |
| WO | 9403941 | A1 | 2/1994 |
| WO | 9733347 | A1 | 9/1997 |

* cited by examiner

MODULAR SYSTEM FOR PRODUCING AN ELECTRICAL UNIT AND TERMINAL DEVICE

CROSS-REFERENCE TO PRIOR APPLICATIONS

This application is a U.S. National Phase application under 35 U.S.C. § 371 of International Application No. PCT/EP2019/050631, filed on Jan. 11, 2019, and claims benefit to Belgian Patent Application No. BE 2018/5032, filed on Jan. 22, 2018. The International Application was published in German on Jul. 25, 2019 as WO 2019/141597 under PCT Article 21(2).

FIELD

The invention relates to a modular system for producing an electrical device.

BACKGROUND

Such a modular system for producing an electrical device comprises a plurality of terminal devices that can be arranged on a printed circuit board for the purpose of connecting electrical conductors to the printed circuit board. The terminal devices each have a housing that has a connection side, arranged on which is a plug-in connection opening for insertion of an electrical conductor, and two lateral flanks, which are spaced apart from each other along a width direction and between which the connection side extends.

By means of a terminal device, one or more electrical conductors can be connected to a printed circuit board. For this purpose, a conductor can be inserted in the plug-in connection opening on the housing and, having been inserted, locked in position in the housing in such a manner that the electrical conductor is held mechanically in the housing and, in addition, is electrically contacted to the terminal device and additionally to the printed circuit board.

Such a terminal device may be attached to contact openings of the printed circuit board, for example by means of contact struts of contact elements, and connected to the printed circuit board by soldering.

Conventional terminal devices are realized as a spring-force terminal or as a screw-connection terminal. By means of spring-force terminals, electrical conductors are locked in position by means of a spring and electrically contacted. In the case of screw-connection terminals, electrical conductors are clamped by means of screw-connection elements and thereby electrically contacted.

In the case of an electrical switching or control device known from DE 102 53 486 A1, a screwless connection terminal, for terminal connection of bared electrical conductors, is realized as an insert for insertion in a box terminal.

Known from DE 198 13 753 A1 is a contact terminal that has a terminal frame, comprising a frame side that has a threaded hole and in which a clamping screw engages. Arranged on a frame side that is opposite the threaded hole is a plug-in connector unit, which has at least one insertion opening for receiving an electrical conductor. A latching spring, for locking an inserted electrical conductor in position, is assigned to the insertion opening.

A terminal block known from DE 10 2010 037 518 A1 has, on the one hand, a spring-loaded terminal and, on the other hand, a screw-connection terminal.

Known from DE 10 2012 110 895 A1 is a spring-force terminal, comprising a spring element and an actuating element for acting upon the spring element.

What is desirable is a modular system that enables differing terminal devices, which may possibly realize differing connection technologies, namely, a spring-force connection technology or a screw-connection technology, to be combined with each other in any manner on a printed circuit board by a user. Conventional systems are usually defined for one connection technology. The use of another connection technology requires a comparatively comprehensive adaptation of interfaces.

SUMMARY

In an embodiment, the present invention provides a modular system for producing an electrical device, comprising: a plurality of terminal devices arrangeable on a printed circuit board to connect electrical conductors to the printed circuit board, the terminal devices each having a housing that has a connection side, arranged on which is a plug-in connection opening for insertion of an electrical conductor, and two lateral flanks, which are spaced apart from each other along a width direction and between which the connection side extends, wherein a first terminal device of the plurality of terminal devices comprises a spring-force terminal, wherein a second terminal device of the plurality of terminal devices comprises a screw-connection terminal, and wherein a housing of the first terminal device and a housing of the second terminal device have a same width, measured along the width direction.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
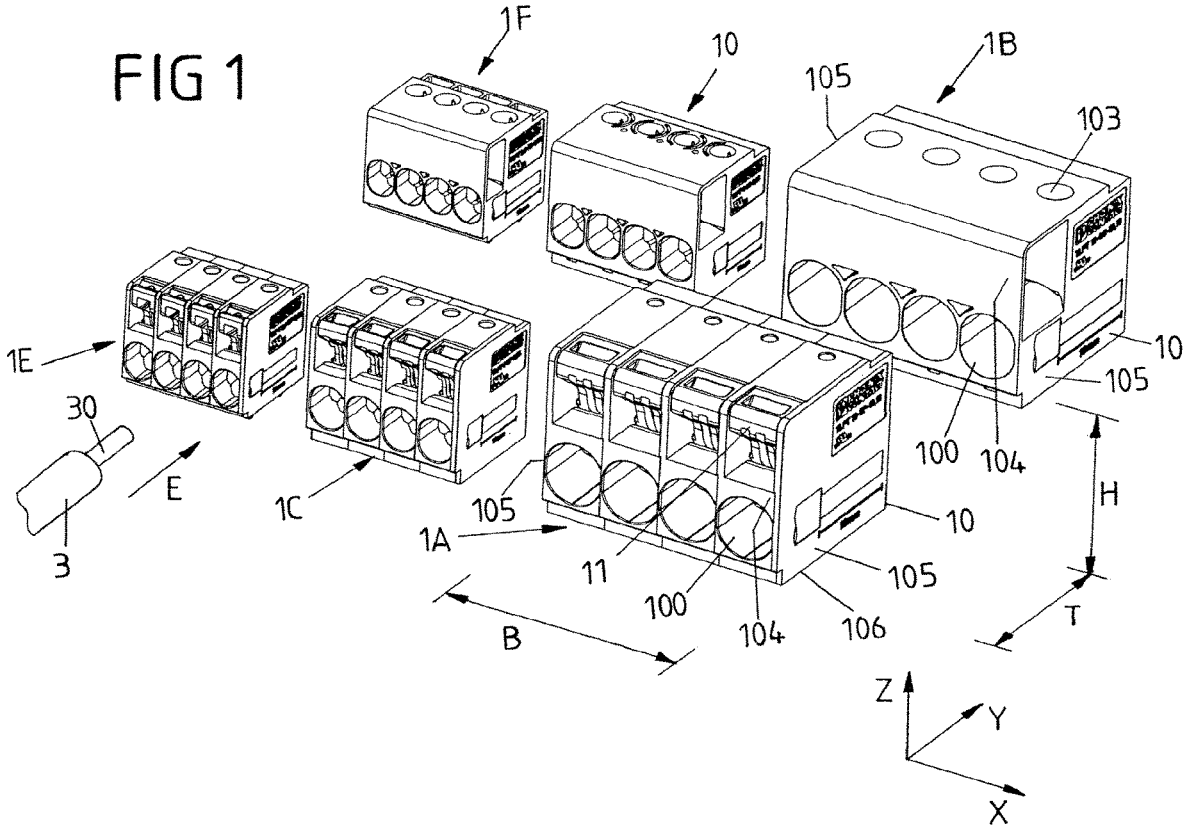
FIG. 1 shows an overview of differing terminal devices of a modular system for providing differing connection technologies.

In an embodiment, the present invention provides a modular system that, in a flexible manner, enables differing connection technologies to be used.

Accordingly, a first terminal device is realized as a spring-force terminal, and a second terminal device is realized as a screw-connection terminal, the housing of the first terminal device and the housing of the second terminal device having the same width, measured along the width direction.

The modular system thus has a plurality of differing terminal devices, which preferably can be combined with each other in a modular manner, in any way. First terminal devices in this case realize a spring-force connection technology, while second terminal devices provide a screw-connection technology. Each terminal device, irrespective of the connection technology used, has a housing, which corresponds in its width to a housing of another terminal device realizing another connection technology.

Since the housings of the terminal devices are matched to each other in their width, the terminal devices can be combined with each other in a modular manner. Thus, a first terminal device or a second terminal device may optionally be used at a mounting space on the printed circuit board, in order to provide a desired connection technology at this mounting space.

The lateral flanks, between which the connection side of the housing of a (first or second) terminal device extends, preferably extend parallel to each other. For example, the housings of the first terminal devices and of the second terminal devices each have a basic shape in the form of a rectangle.

In one design, the housing of each terminal device has a plurality of plug-in connection openings, which are arranged next to each other in a row along the width direction, and which thus provide a row of plug-in connection openings on the connection side. In this case, equal numbers of plug-in connection openings of the same dimensions may be arranged on a first terminal device and on an assigned second terminal device, for insertion of electrical conductors having the same conductor cross section. Conductors of the same kind can thus be attached to the differing terminal devices, but with the terminal devices differing from each other in their connection technology.

It may be provided in this case that there are differing first terminal devices and differing second terminal devices. Thus, first terminal devices may differ from each other in the number of plug-in connection openings and in the dimensioning of the plug-in connection openings. Differing first terminal devices may be realized, for example, for insertion of differing conductors having differing cross sections. Thus, a first terminal device may be realized, for example, for insertion of electrical conductors having a comparatively large conductor cross section, for example 16 $mm^2$, while another first terminal device is realized for insertion of electrical conductors having a comparatively small conductor cross section, for example 2.5 $mm^2$ or 4 $mm^2$. For each first terminal device there may be a corresponding second terminal device, which is realized for insertion of corresponding conductors having a corresponding conductor cross section.

Thus, for a first terminal device, which is realized for insertion of electrical conductors having a particular (for example, comparatively large) conductor cross section, and which for this purpose has a particular number of plug-in connection openings, there may be a corresponding, second terminal device, which has a corresponding number of correspondingly dimensioned plug-in connection openings for insertion of corresponding electrical conductors, and which in this case in its dimensions is the same as the first terminal device.

In one design, the housing of the first terminal device and also the housing of the assigned second terminal device each have an underside, by means of which the respective housing can be attached to the printed circuit board. In this case, the undersides of the housings of the first terminal device and of the second terminal device may have the same dimensions, such that, when attached to the printed circuit board, the terminal devices occupy an area of equal size on the printed circuit board.

In one design, the housing of the first terminal device and the housing of the second terminal device may have the same height, measured along a height direction, perpendicularly in relation to the connection side. The housings of the terminal devices are thus equal in height.

If the housing of the first terminal device and the housing of the second terminal device each have the basic shape of a rectangle, the housings of the first terminal device and of the second terminal device are thus preferably of equal size in their outer dimensions. Modular terminal devices are thus provided, which have the same dimensions and which can thus easily be combined with each other on a printed circuit board.

The terminal devices may each be attached to the printed circuit board via the underside of the housing, and are thereby also electrically contacted to the printed circuit board. For this purpose, each terminal device may have, for example, an electrical contact element, which realizes one or more contact struts that protrude from the housing on the underside and that can be brought into engagement with contact openings of the printed circuit board for the purpose of electrical contacting, in order, for example, to produce soldered connections to the printed circuit board. If the electrical contacting of the terminal devices to the printed circuit board is effected via such contact struts, the first terminal device and the second terminal device preferably have the same pattern of contact struts on the underside, which can be inserted into an associated pattern of contact openings on the printed circuit board. Since the contact struts of the first terminal device and of the second terminal device are in each case arranged at the same location on the respective underside, and consequently the terminal device realize the same patterns of contact struts, the terminal devices can be attached to the printed circuit board in an exchangeable manner, without an adaptation of the printed circuit board, in particular application of other holes to realize contact openings on the printed circuit board, being required for this purpose.

The second terminal device realizes a screw-connection technology, and for this purpose has a screw-connection element that, for the purpose of clamping an electrical conductor in the plug-in connection opening, can be screwed into a screw-connection cage, for example, in order thus to clamp the electrical conductor in the screw-connection cage. The screw-connection element in this case may act, for example, upon a portion of the contact element, in order to bring the latter into pressing contact with an electrical conductor inserted in the plug-in connection opening, such that in this way the electrical conductor is mechanically locked in position in the plug-in connection opening and, in addition, is electrically contacted to the terminal device.

On the other hand, in one design, the first terminal device has a spring element, which serves to lock the electrical conductor in position in the housing when the electrical conductor has been inserted in a plug-in connection opening of the housing. The spring element has, for example, a clamping limb, which can be adjusted elastically in order to mechanically lock in position a conductor that has been inserted in the plug-in connection opening, and to electrically contact it, and in addition also to release the conductor again from the plug-in connection opening. The clamping limb is bent, for example, in relation to a support limb of the spring element, and elastically deformable in relation to the support limb. By means of the support limb the spring element is supported on the housing, and thus held in relation to the housing.

In one design, the first terminal device has an actuating element that can be actuated by a user in order thus to act upon the clamping limb of the spring element. By actuation of the actuating element, the clamping limb can be brought, for example, out of the region of the plug-in connection opening, such that an electrical conductor can be inserted in the plug-in connection opening, or a conductor inserted in plug-in connection opening can be released again from the plug-in connection opening, without the application of a large amount of force. In a deflected position, the clamping limb thus releases the region of the plug-in connection opening, at least to the greatest possible extent. If the actuating element is not actuated, the clamping limb is drawn close to a contacting portion of the contact element arranged in the housing, such that, as a result, an electrical conductor inserted in the plug-in connection opening is pressed against the contacting portion under elastic preload.

The spring element extends, for example, around a bearing portion of the housing, the support limb of the spring element being supported on the housing, and the clamping limb, starting from the bearing portion, pointing into the region of the plug-in connection opening. The actuating element preferably encompasses the spring element in the region of the bearing portion, and for this purpose extends, by an operative portion, around the spring element in the region of the bearing portion. If the actuating element is rotatably mounted on the housing, for example by means of a body accommodated in a bearing opening, then, by rotation of the actuating element in relation to the housing, the operative portion can be brought into operative connection with the clamping limb, in order to adjust the latter elastically and thereby bring it out of the region of the plug-in connection opening, for example in order to insert an electrical conductor into the plug-in connection opening or to remove an inserted conductor from the plug-in connection opening.

Since the operative portion acts upon the clamping limb directly in the region of the bearing portion, this, in combined action with the rotatable mounting of the actuating element, results in a favourable introduction of force into the spring element for the purpose of adjusting the clamping limb. A user may actuate the actuating element, manually or by use of a tool, in a simple, convenient manner, in order thereby to deflect the clamping limb and to insert an electrical conductor into the plug-in connection opening or to remove an inserted conductor from the plug-in connection opening. Following actuation of the actuating element, the actuating element is then moved automatically back in the direction of its non-actuated position, owing to the elastic preload of the spring element.

A rotatable mounting of the actuating element on the housing is provided by means of the body. The operative portion in this case may extend from the body along the width direction, in order to interact with the clamping limb of the spring element.

A first terminal device for realizing a spring-force connection technology of the previously described type may also be used independently of a modular system of the type described here. Such a terminal device for connecting an electrical conductor comprises a housing, which has a plug-in connection opening for insertion of an electrical conductor, a spring element, arranged on the housing and having an elastically adjustable clamping limb, for locking the electrical conductor in position in the plug-in connection opening when it has been inserted in the plug-in connection opening, and an actuating element for elastically adjusting the clamping limb. It is provided in this case that the spring element extends around a bearing portion of the housing, the actuating element having an operative portion, which encompasses the spring element in the region of the bearing portion, and a body, on which the operative portion is arranged and which is rotatably mounted in a bearing opening of the housing.

Reference should also be made to the above with regard to the advantages and advantageous designs of such a clamping device.

FIGS. 1 to 4 show terminal devices 1A-1F of a modular system for connecting electrical conductors 3 to a printed circuit board 2.

Figure 2:
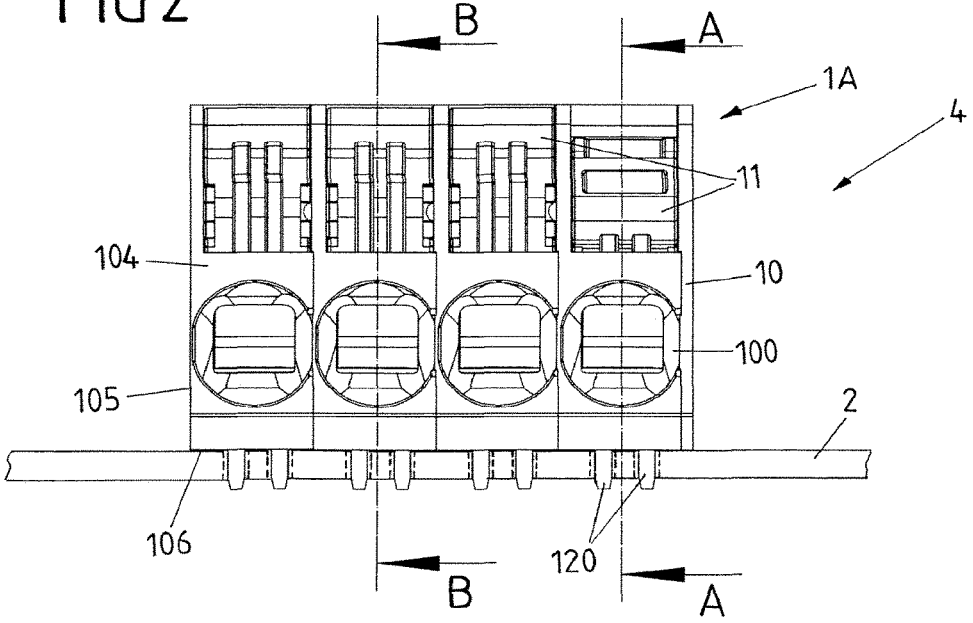
FIG. 2 shows a frontal view of a connection side of a terminal device for realizing a spring-force technology.

As can be seen in particular from FIG. 2, each terminal device 1A-1F may be attached, by an underside 106 of a housing 10, to a printed circuit board 2, and electrically contacted, by contact struts 120 of contact elements 12, to a printed circuit board 2, and also mechanically connected, for example by means of soldered connections, to a printed circuit board 2.

The modular system includes very different terminal devices 1A-1F, which realize differing connection technologies. Each terminal device 1A-1F has a housing 10, having a basic rectangular shape, which can be attached, by an underside 106, to an assigned printed circuit board 2. Plug-in connection openings 100, into which the electrical conductors 3, of—depending on the design of the terminal device 1A-1F—differing conductor cross section, can be inserted, are formed, arranged next to each other in a row along a width direction X, on a connection side 104 that extends, between lateral flanks 105, perpendicularly in relation to the underside 106.

The terminal devices 1A-1F realize, on the one hand, spring-force terminals and, on the other hand, screw-connection terminals. First terminal devices 1A, 1C, 1E in this case realize spring-force terminals, whereas second terminal devices 1B, 1D, 1F realize screw-connection terminals. It is characteristic in this case that, assigned to each spring-force terminal 1A, 1C, 1E, to which electrical conductors 3 having a predefined conductor cross section can be attached, and the plug-in connection openings 100 of which are dimensioned accordingly, there is an associated screw-connection terminal 1B, 1D, 1F, corresponding in structural size, to which electrical conductors 3 having a corresponding conductor cross section can be attached, and the plug-in connection openings 100 of which are dimensioned to correspond to the plug-in connection openings 100 of the respectively associated spring-force terminal 1A, 1C, 1E, such that terminal devices 1A-1F of the same structural size for both spring-force connection technology and for screw-connection technology are present.

In particular, a first terminal device 1A is realized in the form of a spring-force terminal, for example for connecting four electrical conductors 3, having a comparatively large conductor cross section, for example 16 $mm^2$. A corresponding, associated screw-connection terminal 1B has the same dimensions of the housing 10 as the dimensions of the housing 10 of the spring-force terminal 1A, and also the plug-in connection openings 100 of the screw-connection terminal 1*b* are dimensioned to correspond to the plug-in connection openings 100 of the spring-force terminal 1A.

Because the terminal devices 1A, 1B have the same width B along the width direction X, and also the same depth T along the depth direction Y, and the same height H along the height direction Z, the terminal devices 1A, 1B can be used in an exchangeable manner on printed circuit board 2. In this way, a user can optionally use a terminal device 1A, 1B according to the spring-force connection technology or the screw-connection technology, without the need for interfaces of the printed circuit board 2 to be specially adapted for this purpose.

There is also a respective screw-connection terminal 1D, 1F assigned to the spring-force terminals 1C, 1E for electrical conductors 3 that have other conductor cross sections, such that the terminal devices 1C, 1D, 1E, 1F can also be used exchangeably for electrical conductors 3 that have other conductor cross sections.

Each terminal device 1A-1F, irrespective of the connection technology used, has a contact element 12 (see FIGS. 3A, 3B and 4), which protrudes with contact struts 120 on the underside 106 and serves for electrically contacting and also mechanically fastening to the printed circuit board 2. The mutually assigned terminal devices 1A-1F of the differing connection technologies in this case each have the same pattern of contact struts 120 on the underside 106, such that the mutually corresponding terminal devices 1A-1F can be inserted into the same pattern of contact openings 20 of the printed circuit board 2, as is represented schematically in FIG. 5. The arrangement of contact openings 20 on the printed circuit board 2 thus does not have to be adapted according to the connection technology used.

Figure 3A:
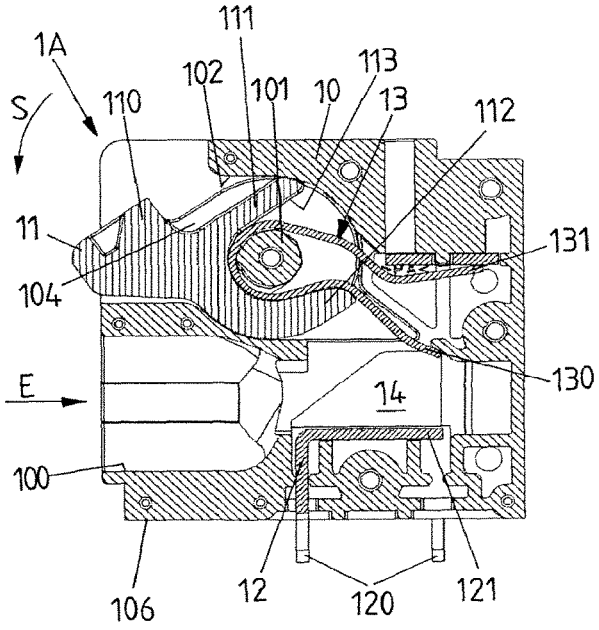
FIG. 3A shows a sectional view along the line A-A according to FIG. 2.
Figure 3B:
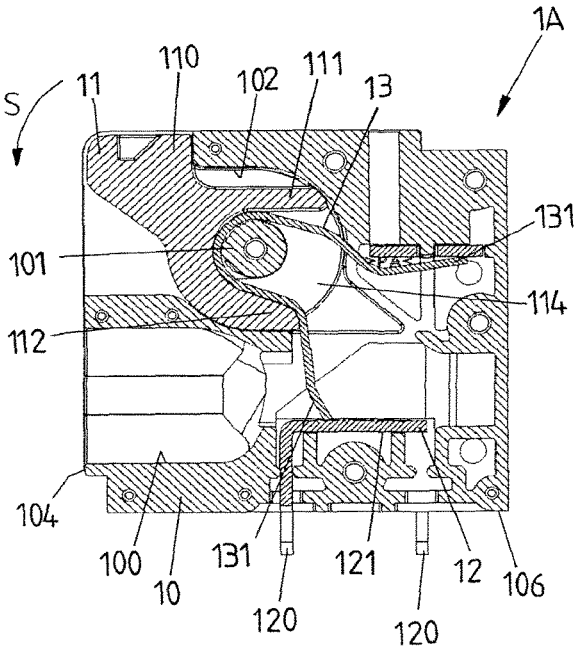
FIG. 3B shows a sectional view along the line B-B according to FIG. 2.

The terminal devices 1A, 1C, 1E realize spring-force terminals, in which there is a spring element 13 arranged in the housing 10 for each plug-in connection opening 100. The spring element 13 has a support limb 131, by means of which the spring element 13 is supported on the housing 10, and a clamping limb 130 that is elastically adjustable in relation to the support limb 131. The spring element 13 is laid around a stud-shaped bearing portion 101 in the housing 10, in such a manner that the clamping limb 130, in an initial position without an electrical conductor 3 inserted in the plug-in connection opening 100, extends into a contacting space 14, within the housing 10, that adjoins the plug-in connection opening 100 and is in bearing contact with a contacting portion 121 of the contact element 12, as is represented in FIG. 3B. The clamping limb 130 can be adjusted out of this initial position, as is represented in FIG. 3A, in order to insert an electrical conductor 3 into the plug-in connection opening 100, in an insertion direction E, and bring it, by means of a (bared) conductor end, into the region of the contacting space 14, or in order to remove an electrical conductor 3, that has already been inserted in the plug-in connection opening 100, back out of the plug-in connection opening 100. In the inserted position, the (bared) conductor end 30 of the conductor 3 is pressed by means of the clamping limb 130, under elastic preload, against the contacting portion 121, is thereby electrically contacted to the contact element 12 and, in addition, is mechanically locked in position in the housing 10.

For the purpose of adjusting the clamping limb 130, an actuating element 11, in the form of a pivoted lever having a body 114, is pivotally mounted in a bearing opening 102 of the housing 10. At an operative portion 112, the actuating element 11 engages, in the region of the bearing portion 101, around the spring element 13 and, via the operative portion 112, is in bearing contact with the clamping limb 130 over a large area in such a manner that, upon pivoting of the actuating element 11, in a pivoting direction S, the actuating element 11 is pivoted about the bearing portion 101 (which is concentric with the bearing opening 102), acts, by its operative portion 112, upon the clamping limb 130 and pivots the latter out of its initial position, in the direction of a release position, as is represented in FIG. 3A.

FIG. 3A shows the actuating element 11 in its actuated position. FIG. 3B, by contrast, shows the actuating element 11 in the non-actuated position.

For a user, as a result of the actuating element 11, by means of its operative portion 112 and a support portion 111 that is diametrically opposite the operative portion 112, which together realize a bearing receiver 113 that encompasses the bearing portion 101, encompassing the spring element 13 in the region of the bearing portion 101 of the housing 10 and the operative portion 112 acting with area contact upon the clamping limb 130 upon the actuating element 11 being pivoted into the pivot position S, convenient operation is achieved for adjusting the clamping limb 130. A user can thus manually, or by use of a tool, act upon a head 110 of the actuating element 11, which is accessible from the outside, in order thereby to pivot the actuating element 11 and to adjust the clamping limb 130, by elastic deformation, relative to the support limb 131, such that, without application of a large amount of force, an electrical conductor 3 can be inserted in the plug-in connection opening 100, or an already inserted conductor 3 can be removed from the plug-in connection opening 100.

The terminal devices 1A, 1C, 1E that realize spring-force terminals are identical in their functional, mechanical design. The terminal devices 1A, 1C, 1E differ only in the dimensioning, in particular of the plug-in connection openings 100, and in the dimensions of the housing 10, as can be seen from FIG. 1.

Figure 4:
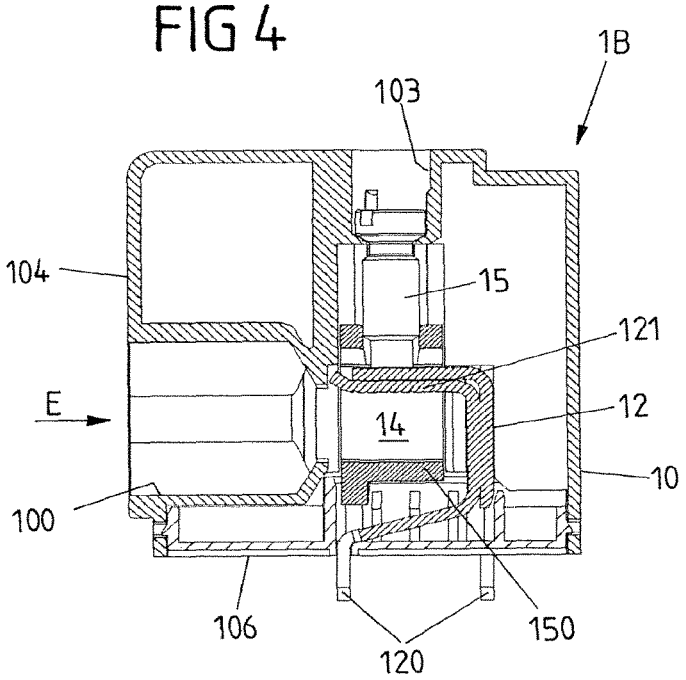
FIG. 4 shows a sectional view of a terminal device for realizing a screw-connection technology.
Figure 5:
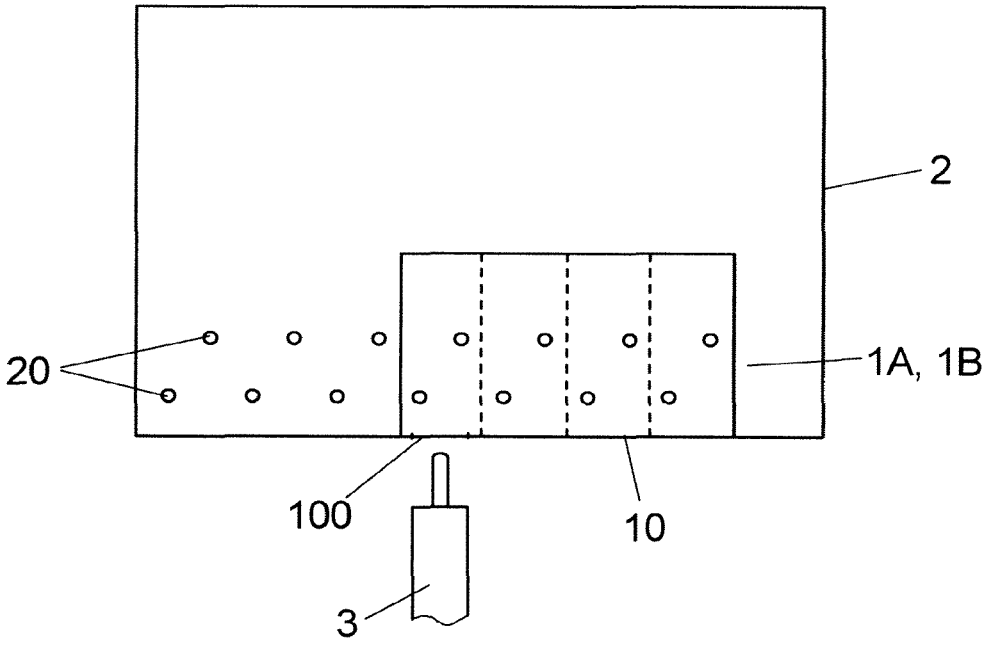
FIG. 5 shows a schematic view of a printed circuit board having, arranged thereon, contact openings for contacting to contact struts of contact elements of a terminal device.

As represented in FIG. 4, the terminal devices 1B, 1D, 1F that realize screw-connection terminals each have a screw-connection element 15, which can be accessed, via a screw-connection opening 103 in the housing 10, by means of a tool, for example a screwdriver, and which is in screw-thread engagement with a screw-connection cage 150. The screw-connection element 15, by means of an end that faces away from its head, acts upon the contact element 12 and is supported on the contact element 12, such that, as a result of the screw-connection element 15 being screwed into the screw-connection cage 150, an electrical conductor 3 that, at a bared conductor end 30, is inserted into the plug-in connection opening 100, becomes clamped in the contacting space 14 formed between the screw-connection cage 150 and the contact element 12, and is thereby electrically contacted to the contact element 12.

As a result of the fact that, assigned to each terminal device 1A, 1C, 1E that realizes a spring-force connection technology, there is a terminal device 1B, 1D, 1F, identical in structural size, that realizes a screw-connection technology, and as a result of the fact that the mutually assigned terminal devices 1A-1F correspond both in the dimensions of the housing, the arrangement and dimensioning of the plug-in connection openings 100, and in the pattern of the contact struts 120 protruding from the underside 106, the mutually assigned terminal devices 1A-1F of differing connection technologies can be interchanged in any manner. This enables differing connection technologies to be used freely on a printed circuit board 2, the differing connection technologies being easily combinable with each other in that both terminal devices 1A, 1C, 1E of the one connection technology and terminal devices 1B, 1D, 1E of the other connection technology are used on a printed circuit board 2.

The concept on which the invention is based is not limited to the preceding exemplary embodiments, but in principle can also be realized in an entirely different manner.

In particular, other arrangements and dimensionings of plug-in connection openings are conceivable and possible, it also being conceivable that differing plug-in connection openings, for electrical conductors of differing cross sections, are provided on a terminal device.

By means of the presented modular system, terminal devices can be combined with each other in a modular manner, such that arrangements of terminal devices of differing connection technologies can be provided on a printed circuit board.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCES

1A-F terminal device
10 housing
100 plug-in connection openings
101 bearing portion
102 bearing opening
103 opening
104 connection side
105 lateral flank
106 base area
11 actuating element
110 head
111 support portion
112 operative portion
113 bearing receiver
114 body
12 contact element
120 contact struts
121 contacting portion
13 spring element
130 clamping limb
131 support limb
14 contacting space
15 screw-connection element
150 screw-connection cage
2 printed circuit board
20 contact openings
3 conductor
4 electrical device
30 conductor end
B width
E insertion direction
H height
S pivot direction
T depth
X width direction
Y depth direction
Z height direction

The invention claimed is:

1. A modular system for producing an electrical device, comprising:

a plurality of terminal devices arrangeable on a printed circuit board to connect electrical conductors to the printed circuit board, the terminal devices each having a housing that has a connection side, arranged on which is a plug-in connection opening for insertion of an electrical conductor, and two lateral flanks, which are spaced apart from each other along a width direction and between which the connection side extends, wherein a first terminal device of the plurality of terminal devices comprises a spring-force terminal, wherein a second terminal device of the plurality of terminal devices differs from the first terminal device by comprising a screw-connection terminal, and wherein a housing of the first terminal device and a housing of the second terminal device have a same width, measured along the width direction.

2. The modular system according to claim 1, wherein the lateral flanks extend parallel to each other.

3. The modular system according to claim 1, wherein the housing of the first terminal device and the housing of the second terminal device each comprises a shape of a rectangle.

4. The modular system according to claim 1, wherein the housing has a plurality of plug-in connection openings arranged on the connection side, next to each other in a row along the width direction.

5. The modular system according to claim 1, wherein the housing of the first terminal device and the housing of the second terminal device attachable, by an underside, to the printed circuit board.

6. The modular system according to claim 5, wherein the underside of the housing of the first terminal device and the underside of the housing of the second terminal device are equal in size.

7. The modular system according to claim 5, wherein the housing of the first terminal device and the housing of the second terminal device have a same height, measured along a height direction, perpendicularly in relation to the connection side.

8. The modular system according to claim 5, wherein the first terminal device and the second terminal device each have at least one electrical contact element, having at least one contact strut, protruding from the underside, for electrically contacting to the printed circuit board.

9. The modular system according to claim 8, wherein the at least one contact strut of the at least one contact element of the first terminal device and the at least one contact strut of the at least one contact element of the second terminal device are arranged at a same location on the respective underside.

10. The modular system according to claim 1, wherein the second terminal device has a screw-connection element configured to clamp the electrical conductor in the plug-in connection opening.

11. The modular system according to claim 1, wherein the first terminal device has a spring element configured to lock the electrical conductor in position in the housing when the electrical conductor has been inserted in the plug-in connection opening.

12. The modular system according to claim 11, wherein the spring element has an elastically adjustable clamping limb configured to lock the electrical conductor in position in the plug-in connection opening.

13. The modular system according to claim 12, wherein the first terminal device has an element configured to elastically adjust the elastically adjustable clamping limb.

14. The modular system according to claim 13, wherein a spring element extends around a bearing portion of the housing, the actuating element having an operative portion that encompasses the spring element in a region of the bearing portion.

15. The modular system according to claim 14, wherein the actuating element has a body from which the operative portion extends along the width direction, and which is rotatably mounted in a bearing opening of the housing.

16. A terminal device for connecting an electrical conductor, comprising:

a housing, which has a plug-in connection opening for insertion of an electrical conductor;

a spring element, arranged on the housing and having an elastically adjustable clamping limb, configured to lock the electrical conductor in position in the plug-in connection opening when the electrical conductor has been inserted in the plug-in connection opening; and an actuating element configured to elastically adjust the clamping limb, wherein the spring element extends around a bearing portion of the housing, and wherein the actuating element has an operative portion, which encompasses the spring element such that both the spring element and the actuating element encompass a region of the bearing portion, and a body, on which the operative portion is arranged and which is rotatably mounted in a bearing opening of the housing.

* * * * *